US008919533B2

(12) United States Patent
Speck

(10) Patent No.: US 8,919,533 B2
(45) Date of Patent: Dec. 30, 2014

(54) TRANSFER DEVICE FOR THE TRANSFER OF A FOLDING BOX

(75) Inventor: Markus Speck, Bruchsal (DE)

(73) Assignee: IWK Verpackungstechnik GmbH, Stutensee (DE)

( * ) Notice: Subject to any disclaimer, the term of this patent is extended or adjusted under 35 U.S.C. 154(b) by 0 days.

(21) Appl. No.: 13/502,538

(22) PCT Filed: Oct. 15, 2010

(86) PCT No.: PCT/EP2010/006316

§ 371 (c)(1),
(2), (4) Date: Apr. 18, 2012

(87) PCT Pub. No.: WO2011/047810

PCT Pub. Date: Apr. 28, 2011

(65) Prior Publication Data

US 2012/0228086 A1 Sep. 13, 2012

(30) Foreign Application Priority Data

Oct. 20, 2009 (DE) ..... 10 2009 050 092

(51) Int. Cl.
*B65B 43/26* (2006.01)
*B65B 43/30* (2006.01)
*B65B 43/52* (2006.01)

(52) U.S. Cl.
CPC ..... *B65B 43/265* (2013.01); *B65B 43/305* (2013.01); *B31B 2201/289* (2013.01); *B31B 2203/003* (2013.01); *B65B 43/52* (2013.01)
USPC ..... 198/469.1; 493/315; 53/564; 198/471.1

(58) Field of Classification Search
CPC ..... B65B 43/265; B65B 43/305
USPC ..... 198/469.1; 493/315
See application file for complete search history.

(56) References Cited

U.S. PATENT DOCUMENTS 4,871,348 A * 10/1989 Konaka ..... 493/315
5,054,761 A * 10/1991 Dietrich et al. ..... 271/95
5,061,231 A * 10/1991 Dietrich et al. ..... 493/315
5,067,937 A * 11/1991 Aschaber et al. ..... 493/310
5,102,385 A * 4/1992 Calvert ..... 493/315

(Continued)

FOREIGN PATENT DOCUMENTS

DE 39 41 867 6/1991
DE 198 01 194 7/1999

(Continued)

*Primary Examiner* — Gene Crawford
*Assistant Examiner* — Thomas Randazzo
(74) *Attorney, Agent, or Firm* — Paul Vincent

(57) ABSTRACT

A transfer device for transferring a flat folding box to a succeeding conveyor device with simultaneous erection has a rotarily driven support part which is pivotable about an axis of rotation, and at least one further rotarily driven support part which rotates coaxially to the support part about the axis of rotation. The folding boxes are received in a receiving station by the retaining device and are conveyed on a curved track to a transfer station and therefore transferred to a succeeding conveyor device. Here the support parts perform a rotary movement at a speed that varies during one revolution and with an opposing relative rotation. Each support part supports a plurality of retaining devices arranged equally distributed along the circumference, wherein the retaining devices of the support parts are preferably arranged alternately and consecutively in the circumferential direction.

10 Claims, 8 Drawing Sheets

(56) References Cited

U.S. PATENT DOCUMENTS

| | | | | |
|---|---|---|---|---|
| 5,156,582 | A * | 10/1992 | Thompson | 493/117 |
| 5,562,581 | A * | 10/1996 | Roberto et al. | 493/310 |
| 5,573,490 | A * | 11/1996 | Steinbrenner et al. | 493/315 |
| 6,383,123 | B1 * | 5/2002 | Ehring et al. | 493/315 |
| 6,503,180 | B1 * | 1/2003 | Pluschow et al. | 493/51 |
| 6,699,165 | B1 * | 3/2004 | Krieger et al. | 493/122 |
| 7,328,561 | B2 * | 2/2008 | Fochler | 53/564 |
| 7,549,277 | B2 * | 6/2009 | Brintazzoli | 53/566 |
| 8,075,466 | B2 * | 12/2011 | Cavallari et al. | 493/105 |

FOREIGN PATENT DOCUMENTS

| | | |
|---|---|---|
| DE | 198 45 384 | 4/2000 |
| DE | 199 09 754 | 9/2000 |
| EP | 0 806 292 | 11/1997 |
| EP | 1 174 256 | 1/2002 |

* cited by examiner

TRANSFER DEVICE FOR THE TRANSFER OF A FOLDING BOX

This application is the national stage of PCT/EP2010/006316 filed on Oct. 15, 2010 and also claims Paris Convention priority of DE 10 2009 050 092.8 filed Oct. 20, 2009.

BACKGROUND OF THE INVENTION

The invention relates to a transfer device for the transfer of a flat folding box to a succeeding conveyor device with simultaneous erection with a rotarily driven support part which is rotatable about an axis of rotation, and at least one rotarily driven further support part which is rotatable about the axis of rotation coaxially to the support part, wherein the support parts each support at least one retaining device and perform a rotary movement at a speed of rotation which varies during one revolution and an opposing relative rotation, wherein the folding box can be received in a receiving station by the retaining device and can be conveyed on a curved track to a transfer station and can there be transferred to the succeeding conveyor device.

Such a transfer device is used, for example, in a cartooning machine where it is first necessary to erect a folding box in the flat folded condition before feeding a product to be packed, and to make it available in a succeeding conveyor device which is normally designed as a belt or chain conveyor.

In a transfer device of known construction, as shown for example in DE 198 01 194 A1, the folding boxes are presented in stacked condition in a hopper, the lower folding box of each stack is gripped by a retaining device, which is normally designed in the form of a suction device, and removed from the hopper. The retaining device is fitted on a support part which forms a planetary part in a planetary gear so that the retaining device is fed on a cycloid track to the succeeding conveyor device and is deposited in a cell formed in it. During the movement along the cycloid track the folding box is erected by stops and an erection finger.

The design of the cycloid track, as opposed to a pure circular movement, has the advantage that during the cycloid movement a plurality of turning points are formed in which the retaining device is moved at reduced speed. This is necessary to guarantee precise removal of the folding box from the hopper, precise erection of the folding box and correct depositing of the folding box on the succeeding conveyor device.

It has been shown in practice, however, that in the case of a further increase in the output of the transfer device problems arise, particularly when removing the folding box from the hopper, since the forces acting there present the risk that the folding box gripped by the retaining device also pull out a plurality of folding boxes on top of them because of the high speed of removal, which boxes then fall loosely into the transfer device and may prevent the latter from operating. In order to provide a period sufficient for the folding boxes to be received by the retaining device a planetary gear with a very complicated structure with superimposed correction movements is required, which is very expensive to design and is therefore cost-intensive.

DE 198 45 384 A1 discloses a transfer device of the inventive kind. In such a transfer device a plurality of independent support parts are provided, each of which supports a retaining device in the form of a suction cup. The support parts are rotatable about a common axis of rotation and each has its own drive motor. This enables the retaining devices to be moved during a revolution at a variable speed of rotation and to perform a mutual relative rotation, as a result of which the movement processes can be adapted to the function required at any time, i.e. the receiving of the folding boxes or their transfer to the succeeding conveyor device. However, the design cost is very high and the transfer device is relatively expensive since each retaining device requires its own drive motor. Moreover, the number of retaining devices and hence the output of the transfer device are very limited for space reasons.

The object of the invention is therefore to provide a transfer device of the type mentioned which is of simple structural design and guarantees reliable transfer of the folding box to the conveyor device, even at high cycle numbers.

SUMMARY OF THE INVENTION

This object is achieved by a transfer device with the features according to the independent claim. Here provision is made for each support part to support a plurality of retaining devices distributed around the circumference.

The invention takes as its starting point the basic consideration that not every retaining device can be assigned its own drive but that the retaining devices can be divided into several groups, the retaining devices of each group being arranged on a common rotarily driven support part and rotating with them. Provision is made, for example, in addition to a rotarily driven support part, which supports some of the retaining devices distributed around the circumference, particularly in the form of suction cups of a $1^{st}$ group, for at least one further rotarily driven support part to be provided which also supports a plurality of retaining devices distributed around the circumference, particularly in the form of suction cups of a $2^{nd}$ group, and for them to be rotated about the axis of rotation coaxially to the support part of the $1^{st}$ group. Each of the two support parts performs a rotary movement at a speed of rotation that varies during one revolution. This enables a retaining device to be moved at a much slower speed than during its movement between the individual workstations, for example in the region of the receiving station in which it receives a folding box. To ensure that the reduction in the speed of rotation of a retaining device at certain intervals of its rotary movement beacons does not result in a reduction of the output of the transfer device, both support parts may perform a mutual relative rotation. This means that the support part of the $1^{st}$ group can be moved at high speed in the direction of rotation, whilst the further support part of the $2^{nd}$ group has at the same time a reduced speed of rotation in order to receive or discharge a folding box, for example. Since the support parts are moved in sections at a higher and lower speed of rotation, this difference is equalised over one complete revolution of the support parts so that the end of one rotation the support parts and also their retaining devices again show the initial position assumed at the beginning of the revolution.

In one possible design of the invention provision may be made for exactly two support parts to be provided, each of which support three to five retaining devices and, in particular, four retaining devices. Therefore six to ten and preferably eight retaining devices are arranged on the two support parts for which only two drive motors are required.

In an alternative design of the invention exactly three support parts may be provided, each of which support two to four retaining devices, and preferably three retaining devices. In this manner a total of six to twelve, and preferably nine retaining devices are provided for which three drive motors are required.

In a preferred design of the invention provision is made for the retaining devices of the support parts to be arranged alternately in succession in the peripheral direction. When two supporting devices are provided the retaining devices of the $1^{st}$ support part alternate with the retaining devices of the $2^{nd}$ support part, i.e. the arrangement follows a series 1-2-1-2-1-2 etc.

When three support parts are provided, the arrangement of the retaining devices of the $1^{st}$ support part, the $2^{nd}$ support part and the $3^{rd}$ support part are preferably provided in the series 1-2-3-1-2-3 etc.

In one possible design of the invention provision may be made for each support part to be formed by a disc-like wheel, for example in the form of a circular plate, wherein the wheels or plates are preferably arranged parallel with each other and rotate about a common axis of rotation.

The support parts are preferably driven independently of each other by means of a driving device. The driving device comprises, in particular, a plurality of servomotors where one servomotor is assigned to each support part so that the support parts can be rotated completely independently of each other.

Each support part should have at least three retaining devices which are preferably distributed uniformly around the circumference of the support part. When four retaining devices are arranged for each support part, they are arranged in a mutual angular offset of 90° in the peripheral direction and direction of rotation so that two retaining devices are always diametrically opposed to each other. In particular, the retaining devices on the support part should be arranged so that one retaining device is located in the transfer station for discharging the folding box to the succeeding conveyor device when another retaining of this support part and, in particular, the diametrically opposite retaining device of this support part, is located in the receiving station for receiving a folding box, since both these stations require a comparatively low speed of rotation of the support part to guarantee safe handling of the folding box.

The support parts are rotated about a common axis of rotation. Preferably the retaining devices are securely connected to each support part so that they also perform a pure rotary movement, i.e. are moved on a circular path. In addition, however, provision may also be made for a further movement directed outwardly radially to the axis of rotation, e.g. via a circular path, to be imposed on each retaining device, should this be necessary for receiving the folding box, its erection or transfer.

In a preferred design of the invention provision is made for the folding boxes to be fed to the transfer station separately and received by the retaining devices individually. It has been shown that an already separated folding box can be received by the retaining device at a much higher speed than the receiving of a magazine stack. In order to improve the performance of the transfer device the folding boxes can already be separated on the other side of the transfer station, then fed to the transfer station in a row, in which case the retaining devices always receive the front folding boxes in the row of folding boxes.

In a preferred design of the invention provision is made for an erection mechanism to be assigned to retaining device in the form of an erection finger which is movable by means of an erection gear. The erection gear is preferably controlled by a curved track so that the erection finger performs a defined swivel movement during the rotary movement of each support part and ensures that the folding box is positioned correctly.

By a method of prior art a erection station can be arranged between the receiving station and the transfer station, in which erection station the folding box still in the flat condition is run against a stop or a counter suction device and then at least partially erected when pulled out. In order to improve the performance of the transfer device provision is made, as a further development of the invention, for the counter suction device to follow the rotary movement of the folding box. This can be achieved either by moving the counter suction tangentially to the rotary movement of the support part and the corresponding retaining device. Alternatively, however, it is also possible to mount the counter suction device on a rotary support and synchronise it at its own speed with the rotary movement of the retaining devices so that the counter suction device and the retaining device supporting the folding box are arranged opposite each other in one condition of their movements.

BRIEF DESCRIPTION OF THE DRAWING

Further details and features of the invention are apparent from the following description of an exemplary embodiment with reference to the drawing, where.

DESCRIPTION OF THE PREFERRED EMBODIMENT

Figure 1:
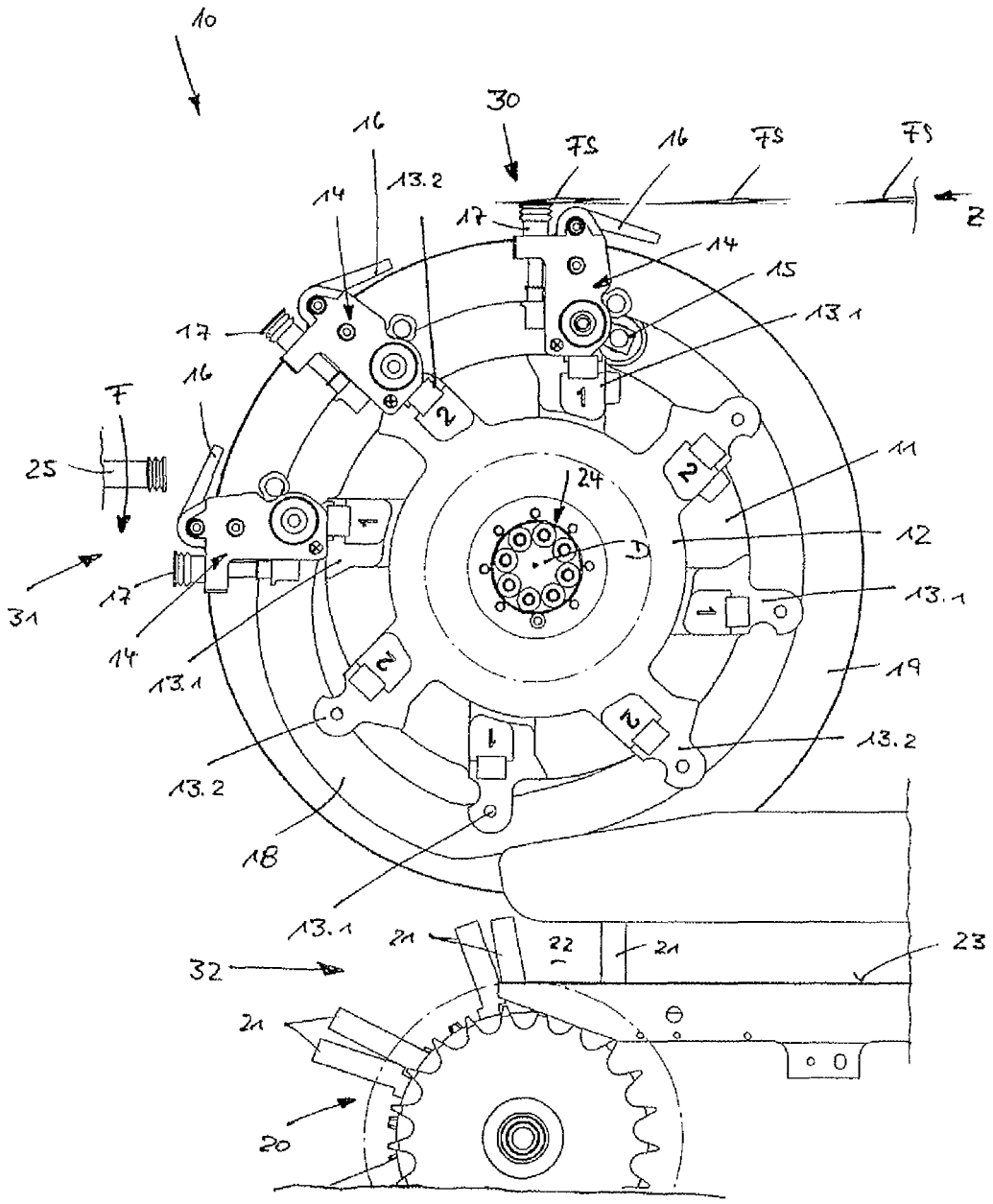
FIG. 1 shows a schematic view of a $1^{st}$ embodiment of the transfer device according to the invention in an initial condition.

FIGS. 1 to 7 show a $1^{st}$ embodiment of a transfer device 10 according to the invention in different phases of the transfer process. Transfer device 10 has a base part 19 on which is pivoted a $1^{st}$ support part 11, which in the exemplary embodiment shown assumes the form of an essentially circular plate or a disc-shaped wheel by means of a pivot bearing 24 about an axis of rotation D running perpendicularly to the drawing plane.

In the circumferential region of the $1^{st}$ support part 11 are formed four supports 13.1 on which are fitted an erecting gear 14 and a retaining device pointing radially outwards in the form of a suction device. An erecting finger 16 is assigned to erecting gear 14 and a cam roller 15 is provided for controlling erecting gear 14, which roller rolls off in a grooved curved track 18, which is formed in base part 19.

The $1^{st}$ support part 11 has four supports 13.1 and a corresponding number of supporting devices 17, erecting gears 14, erecting fingers 16 and cam rollers 15, and in this case only two corresponding structural units are shown for reasons of clarity. The four supports 13.1 are equally distributed over the circumference of the $1^{st}$ support part 11, i.e. arranged in a mutual angular offset of 90° in the circumferential direction.

Furthermore, transfer device 10 comprises a $2^{nd}$ support part which, in the exemplary embodiment shown,. Is also designed in the form of an essentially circular plate or a disc-shaped wheel, and is swivelled about the axis of rotation D by means of swivel bearing 24. The $2^{nd}$ support part 12 also has four outwardly pointing supports 13.2 arranged equally distributed along the circumference, on which supports are arranged, in the manner shown, an erecting gear 14 with an erecting finger 16 and a retaining device 17 pointing radially outwards in the form of a suction device. Supports 13.2 and therefore the components secured to them are also distributed evenly along the circumference of the $2^{nd}$ support part 12 and are therefore arranged in a mutual angular offset of 90° in the circumferential direction. In this case only one of supports 13.2, with an erecting gear 14, an erecting finger 16 and a retaining device 17, is shown in the figures for the sake of clarity.

In order to be able to follow the movement of the individual components more effectively during the different phases of a transfer shown in the figures, supports 13.1 of the $1^{st}$ support part 11 are denoted once again by the number "1" and supports 13.2 of the $2^{nd}$ support part 12 by the number "2".

As FIG. 1 shows, supports 13.2 of the $2^{nd}$ support part 12 are aligned in the initial condition shown in the figure in an angular offset of 45° between two adjacent supports 13.1 of the $1^{st}$ support part 11 so that retaining devices 17 of the $1^{st}$ and $2^{nd}$ support parts 11, 12 are arranged alternately and consecutively in the circumferential direction and in the direction of rotation respectively (sequence: 1-2-1-2-1-2 . . . ).

A receiving station 30 is provided in the upper region of transverse device 10. Receiving station 30, which is not shown in greater detail, flat folding boxes FS are fed separately in a row, as indicated by arrow Z. In the direction of rotation, i.e. offset approx 90° to receiving station 30 in the anticlockwise direction according to the figures, an erecting station 25 is provided a counter suction device 25 of which is shown only schematically, which is swivelled by means of a support, not shown, about an axis running parallel with axis of rotation D, and hence in a rotary position in which it faces transfer device 10, with folding box FS supported by a retaining device 17 comes into contact, which is explained in detail later. The rotary movement of counter suction device 25 is denoted by arrow F.

A transfer station 32 is provided in the lower region of transverse device 10 and hence essentially diametrically opposite receiving station 30 relative to axis of rotation D. Transfer station 32 comprises a succeeding conveyor device 20, which is represented as a chain conveyor, the chain having normally radially projecting fingers 21, between which are formed cells 22 into which a folding box FS can be inserted in the erected condition. In addition the succeeding conveyor device comprises a guide 23 for the folding boxes arranged in cells 22.

The $1^{st}$ support part 11 and the $2^{nd}$ support part 12 are each rotarily driven by means of their own servomotors not shown, and in this case the two support parts 11 and 12 each perform on the one hand, during a transfer process, a rotary movement at a speed of rotation varying during one revolution, and on the other hand an opposing relative movement or rotation.

A transfer process is explained in the following in individual phases in FIGS. 1 to 7. A retaining device 17 of the $1^{st}$ support part 11 in receiving station 30 is in the phase at the beginning of a transfer process shown in FIG. 1, and comes into contact with a supplied folding box FS on its radially external side. Folding box FS is received due to the action of low pressure on retaining device 17 designed as a suction device. The received folding box FS then rotates together with the $1^{st}$ support part 11 in the anticlockwise direction and reaches erecting station 31, on which the outside of the folding box comes into contact with counter suction device 25 (see FIG. 4), as a result of which folding box FS is collapsed to a small extent by a method of prior art. During the further movement of retaining device 17 supporting folding box FS erecting finger 16 operates between erecting station 31 and transfer station 32. Erecting gear 14 is actuated by the engagement of cam roller 15 in curved track 18 so that erecting finger 16 presses folding box FS laterally into its desired shape (see FIGS. 5 and 6). When retaining device 17 supporting folding box FS reaches transfer station 32, folding box FS is fully erected and can be inserted in a cell 22 of succeeding conveyor device 20. Retaining device 17 then releases folding box FS and returns to the upper receiving station 30 as a result of the further rotation of the $1^{st}$ support part 11.

Whilst retaining devices 17 of the $1^{st}$ support part 11 are located in receiving station 30 or in erecting station 31 or transfer station 32 (referred to in the following as workstations), the $1^{st}$ support part rotates at a lower speed of rotation than in the regions situated between the workstations. This leads to a situation where the $1^{st}$ support part performs a movement at variable speeds of rotation during one revolution. Since supports 13.1 and retaining devices 17 of the $1^{st}$ support part secured to them are arranged diametrically opposed to each other in pairs, and since receiving station 30 is also arranged diametrically opposed to each other relative to axis of rotation D, a corresponding reduction in the speed of the diametrically opposed retaining device 17 in transfer station 32 is at the same time also guaranteed if the rotary movement of a support 13.1 or a retaining device 17 mounted on it in transfer station 30 if the rotary movement is decelerated.

The $2^{nd}$ support part 12 also performs a corresponding rotary movement at a speed that varies during one revolution and, in particular, during a reduction in the speed of rotation of the retaining devices in the regions of the workstations. Since retaining devices 17 of the two support parts 11, 12 are always located in different regions which are passed through at different speeds, both support parts 11 and 12 perform an opposing relative rotation about axis of rotation D during one revolution.

Figure 2:
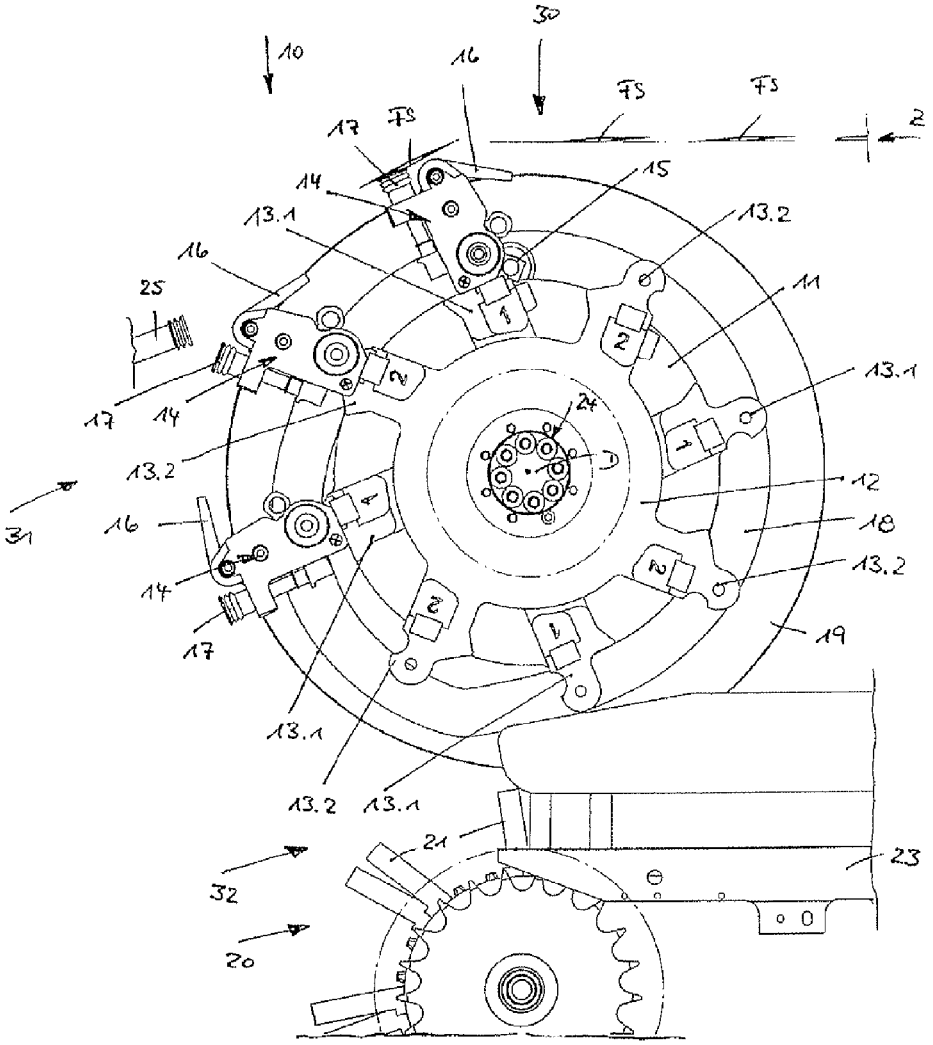
FIG. 2 shows the transfer device according to FIG. 1 in a $2^{nd}$ phase of the transfer.

In the phase shown in FIG. 1 supports 13.1 of the $1^{st}$ support part 11 and supports 13.2 of the $2^{nd}$ support part 12 are arranged offset 45° to each other in the circumferential direction. Since the $1^{st}$ support part 11 and $2^{nd}$ support part rotate at approximately the same speed of rotation in this phase, this leads to a situation where the mutual distance between supports 13.1 and 13.2 of the two support parts 11 and 12 are as shown in FIG. 2, even after a rotation of approx. 30° in the circumferential direction.

Figure 3:
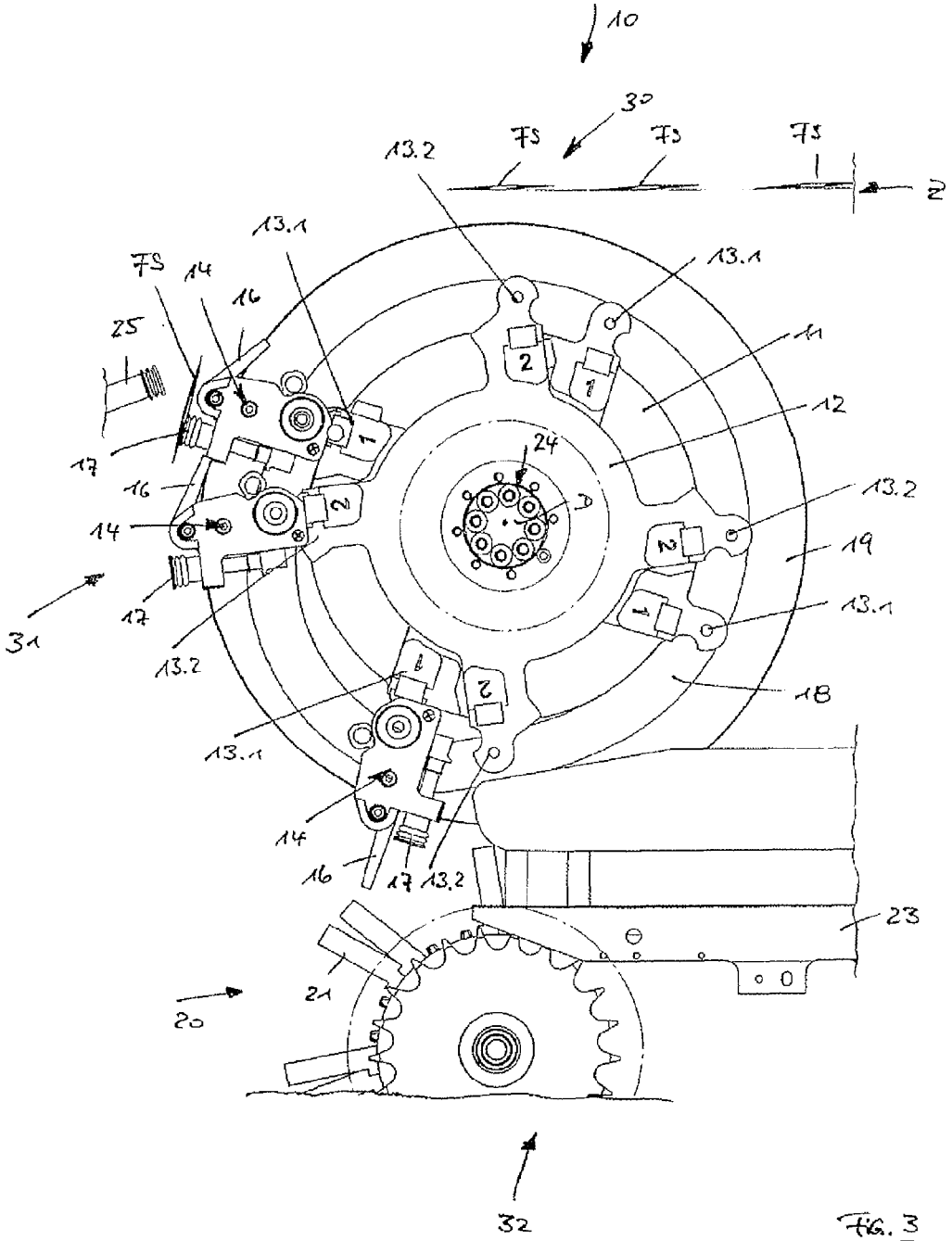
FIG. 3 shows the transfer device according to FIG. 1 in $3^{rd}$ phase of the transfer.
Figure 4:
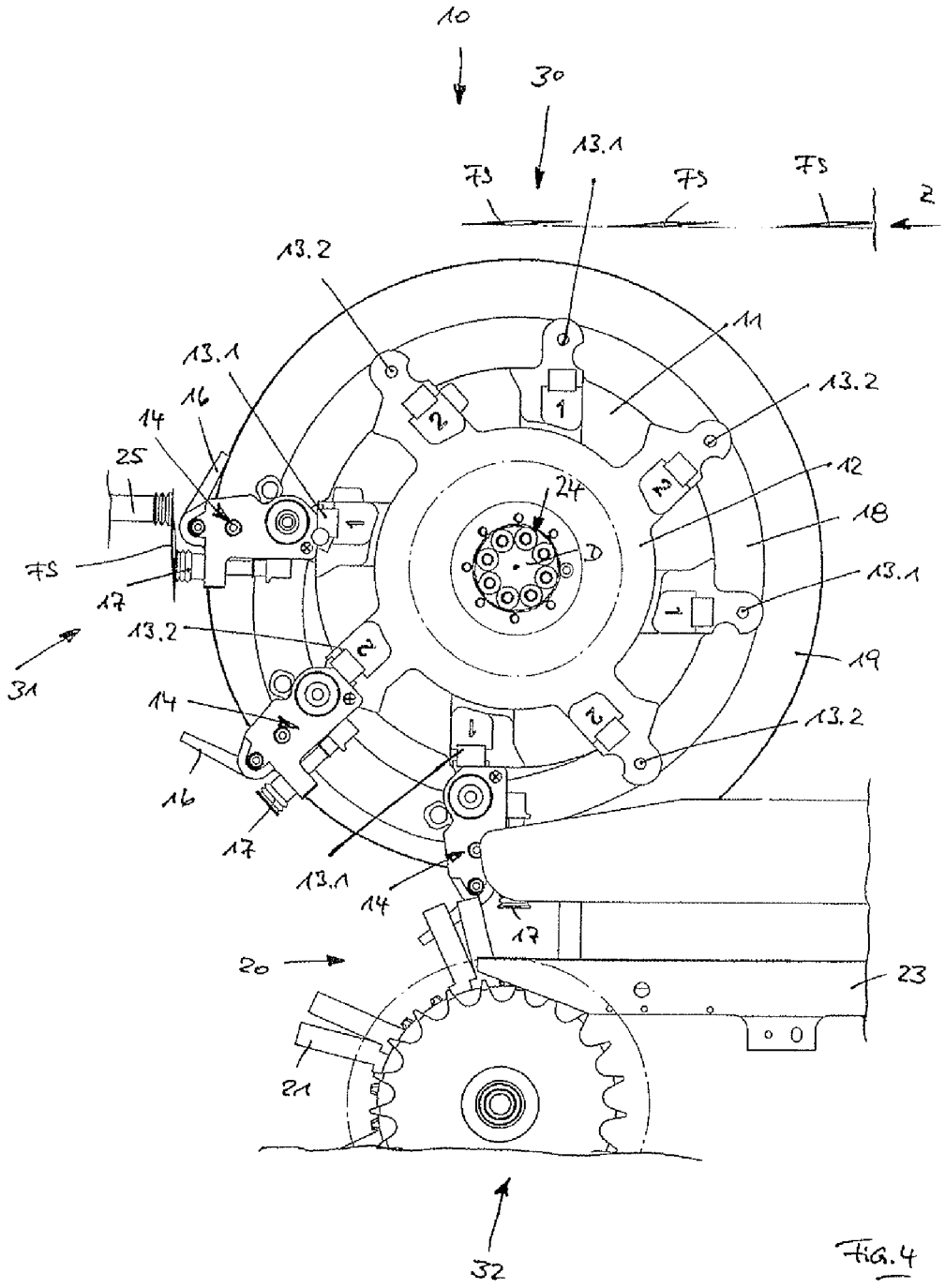
FIG. 4 shows the transfer device according to FIG. 1 in a $4^{th}$ phase of the transfer.
Figure 5:
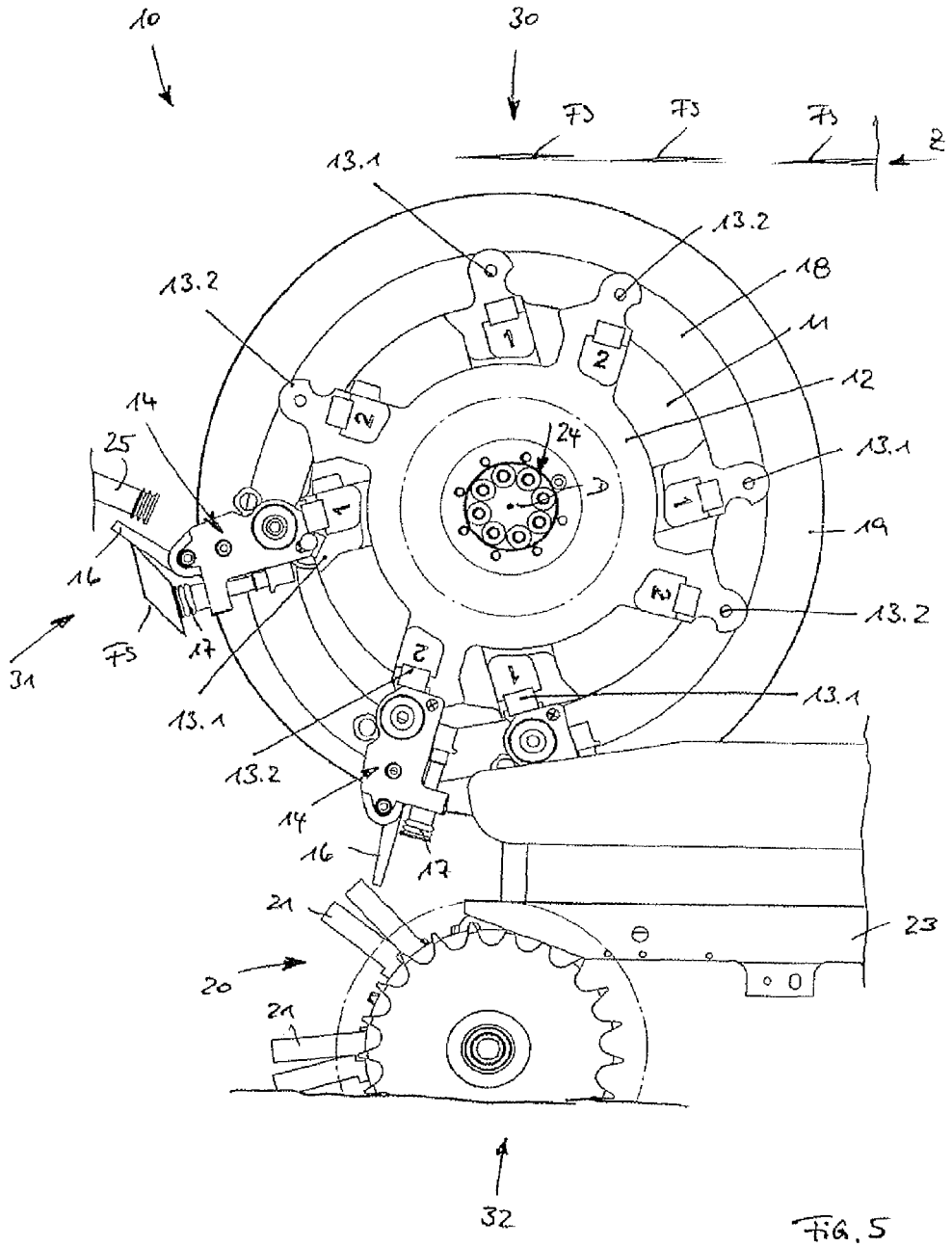
FIG. 5 shows the transfer device according to FIG. 1 in $5^{th}$ phase of the transfer.
Figure 6:
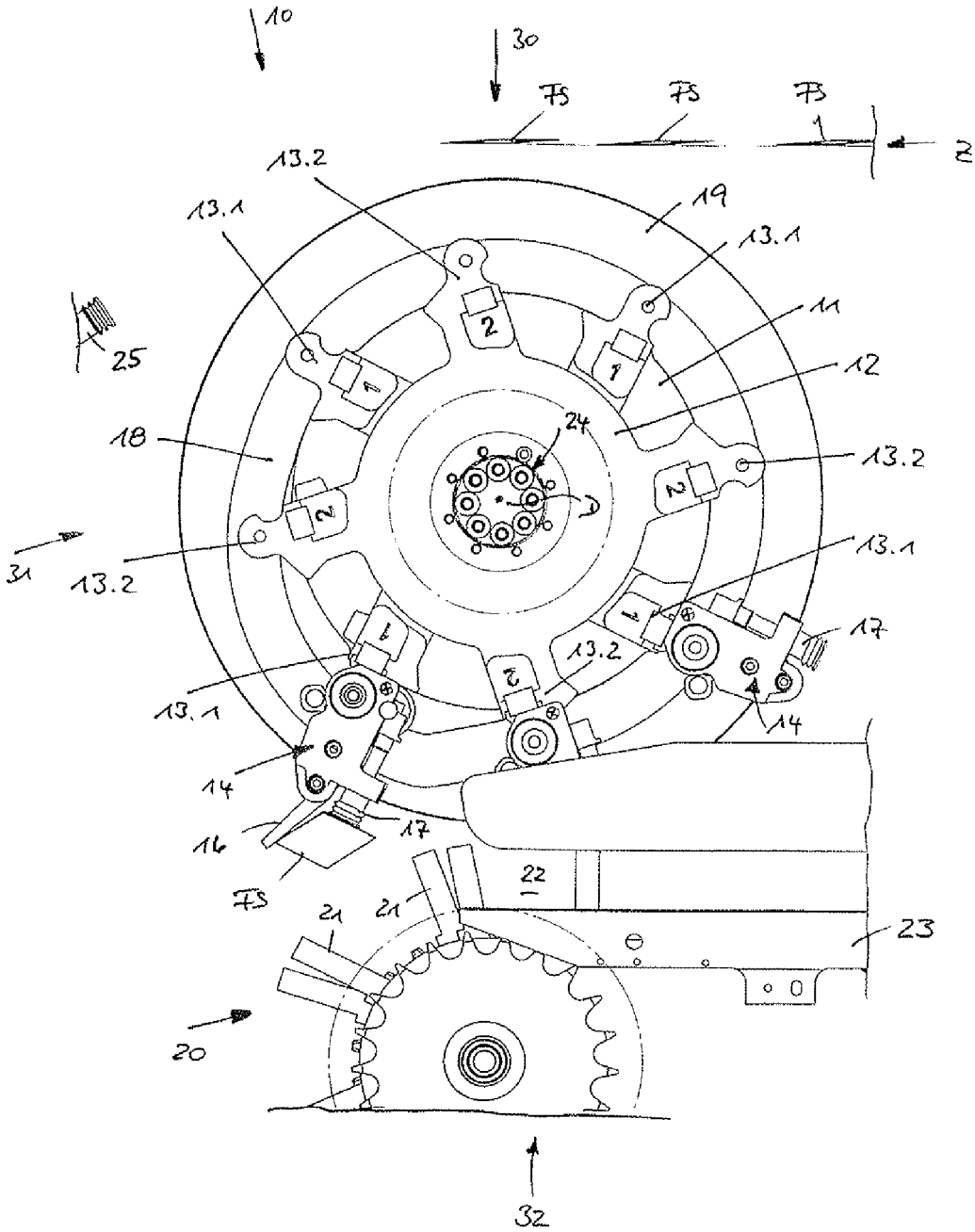
FIG. 6 shows the transfer device according to FIG. 1 in a $6^{th}$ phase of the transfer.
Figure 7:
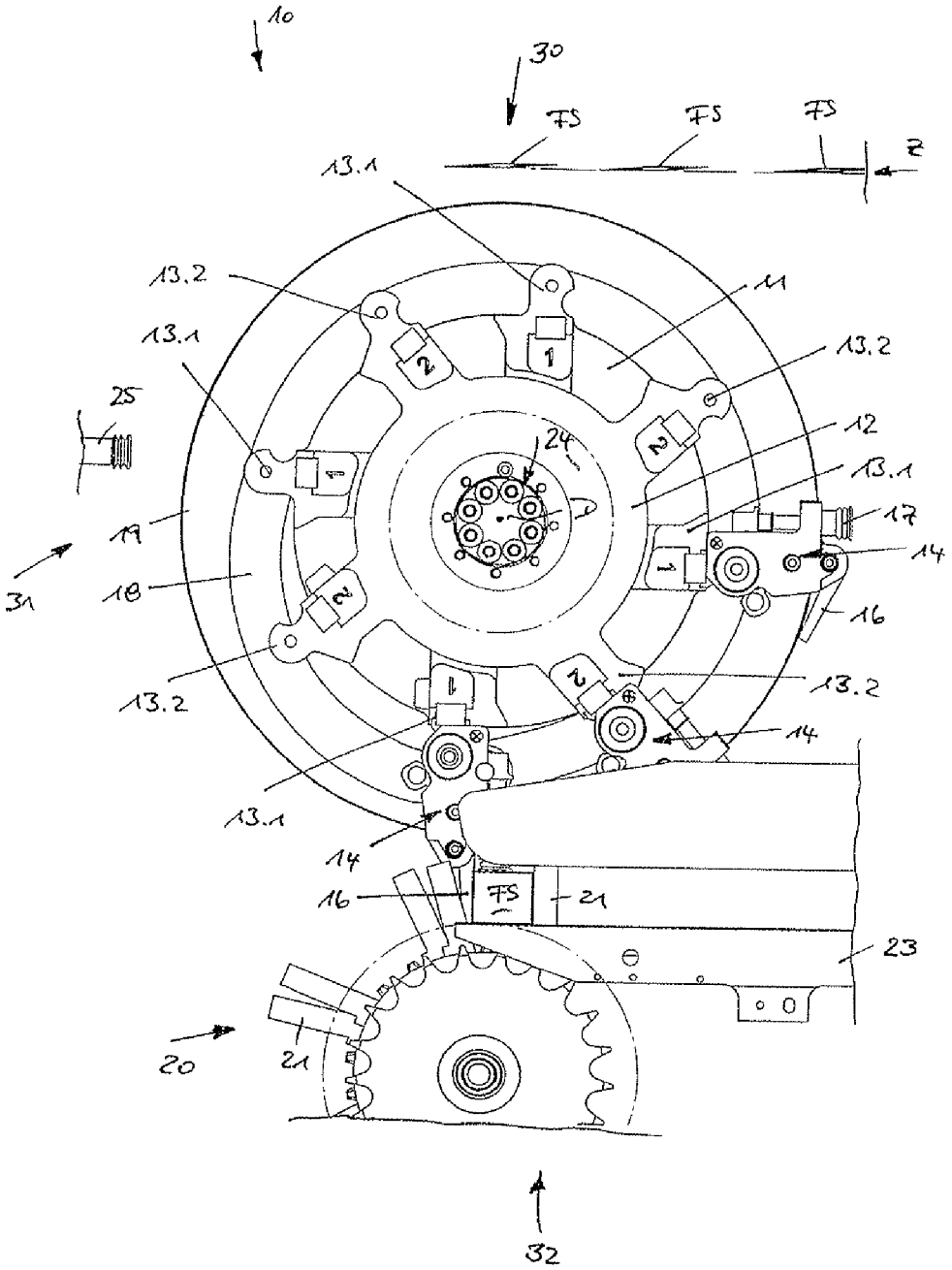
FIG. 7 shows the transfer device according to FIG. 1 in the final phase of the transfer and FIG. 8 shows a schematic view of a $2^{nd}$ embodiment of the transfer device according to the invention.

Since supports 13.2 of the $2^{nd}$ support part 12 and retaining devices mounted on them approach one of workstations 30, 31, 32 as the rotation continues, the speed of the $2^{nd}$ support part 12 is reduced, as a result of which supports 13.1 of the $1^{st}$ support part 11 and retaining devices 17 mounted on them run onto supports 13.2 of the $2^{nd}$ support part 12 due to their higher instantaneous speed, but without contacting them. This condition is shown in FIG. 3.

As the rotation continues the speed of rotation of the $1^{st}$ support part 11 is reduced because its supports 13.1 are approaching the workstations, whilst at the same time the speed of the $2^{nd}$ support part is again increased since they are leaving the region of the workstations. In an intermediate position according to FIG. 4, in which supports 13.1 of the $1^{st}$ support part and supports 17 mounted on them are located in the workstations, the 2nd support part 12 again reaches a position with a 45° offset to the $1^{st}$ support part 11 in the circumferential direction and then in turn runs onto supports 13.1 of the $1^{st}$ support part because of the higher instantaneous speed (see FIG. 5), which is then again compensated for by an increase in the speed of rotation of the $1^{st}$ support part 11.

Figure 8:
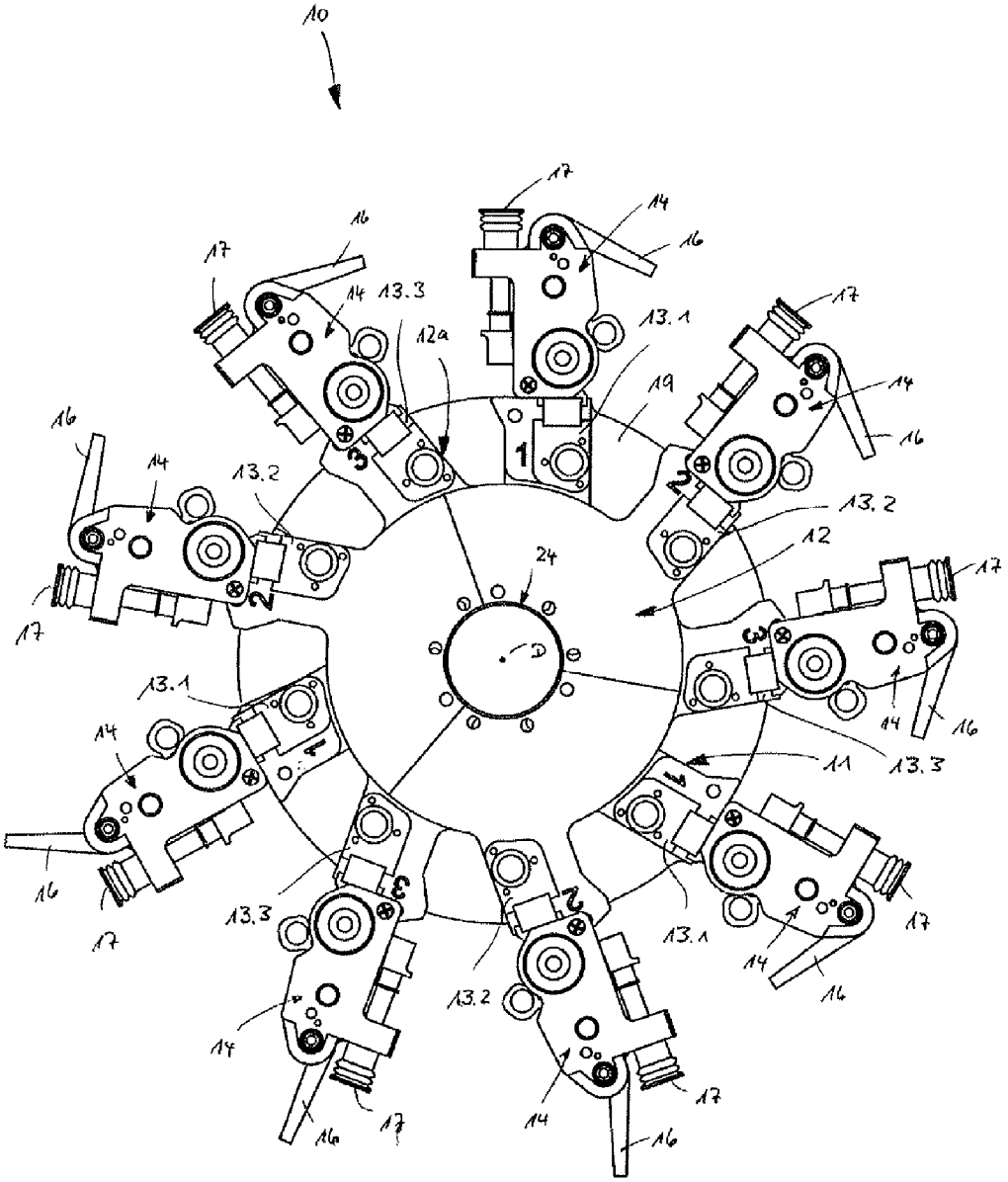

FIG. 8 shows a schematic view of a $2^{nd}$ embodiment of transfer device 10 according to the invention. This differs from the $1^{st}$ embodiment according to FIG. 1 in terms of the number of support parts and retaining devices. The $1^{st}$ support part 11 according to FIG. 8 has three supports 13.1 and a corresponding number of retaining devices 17, erecting gears 14, erecting fingers 16 and cam rollers. The three supports 13.1 are distributed equally along the circumference of the $1^{st}$ support part 11, i.e. arranged at a mutual angular offset of 120° in the circumferential direction.

The $2^{nd}$ support part 12 also has three outwardly pointing supports 13.2 arranged equally distributed along the circumference, on which supports are arranged an erecting gear 14 with an erecting finger 16 and a retaining device 17 pointing radially outwards in the form of a suction device. Supports 13.2 are also uniformly distributed along the circumference of the $2^{nd}$ support part 12 and are therefore arranged in a mutual angular offset of 120° in the circumferential direction.

In addition to the $1^{st}$ support part 11 and the $2^{nd}$ support part 12, a $3^{rd}$ support part 12*a* is provided in the embodiment shown in FIG. 8, which support part is also designed in the form of an essentially circular plate or a disc-shaped wheel, and is swivelled about axis of rotation D by means of swivel bearing 24. The $3^{rd}$ support part 12*a* also has three outwardly pointing supports 13.3 arranged equally distributed along the circumference, on which supports are arranged an erecting gear 14 with an erecting finger 16 and retaining device 17 pointing radially outwards in the form of a suction device. Supports 13.3 are also distributed uniformly along the circumference of the $3^{rd}$ support part 12*a* and are therefore arranged in a mutual angular offset of 120° in the circumferential direction.

In order to illustrate the mutual arrangement of the supports in the circumferential direction, supports 1.1 of the $1^{st}$ support part 11 are specially denoted by the number "1", supports 13.2 of the $2^{nd}$ support part 12 by the number "2" and supports 13.3 of the $3^{rd}$ support part 12*a* by number "3". As FIG. 8 shows, the supports of the three support parts 11, 12 and 12*a* are arranged in the circumferential direction so that a support 13.2 of the $2^{nd}$ support 12 always follows supports 13.1 of the $1^{st}$ support part 11, and this is followed by a support 13.3 of the $3^{rd}$ support part 13.3 (sequence: 1-2-3-1-2-3 etc.).

Each support part 11, 12, and 12*a* is driven by its own drive motor so that the functionality corresponds essentially to the functionality of the transfer device according to FIG. 1, to whose description reference is made.

A mutual relative rotation is provided between support parts and 12 and 11, 12 and 12*a* respectively and retaining devices 17 mounted on them by an increase and reduction in the speed of rotation offset in terms of time. This design enables retaining devices 17 to operate in the region of the workstations at a lower speed of rotation than in the regions between the workstations, and nevertheless to guarantee a high performance of the transfer device by the arrangement of at least support parts with the structure mentioned.

I claim:

1. A transfer device for transferring a flat folding box along a curved track from a receiving station to a conveyor device of a transfer station and for simultaneously erecting the flat folding box, the transfer device having retaining devices that are subdivided into a plurality of groups, the transfer device comprising:

a rotationally driven first support part, said first support part disposed to rotate about an axis of rotation with a speed of rotation which varies during a rotation cycle;

a plurality of first supports disposed at and distributed about a circumference of said first support part, each of said first supports having a first retaining device, wherein each first retaining device is structured to receive one single folding box at the receiving station for conveying the folding box to the transfer station and for transfer of the folding box to the conveyor device, said first retaining devices thereby constituting a first group of retaining devices which are all mounted to and rotate as a unit along with said first support part, wherein said first group of retaining devices comprises at least two first retaining devices;

a first drive mechanism connected to said first support part, said first drive mechanism thereby constituting one single common drive for all of said first retaining devices in said first group:

at least one rotationally driven second support part, said at least one second support part disposed to rotate about the axis of rotation, coaxially with respect to said first support part and with a second speed of rotation which varies during said rotation cycle;

a plurality of second supports disposed at and distributed about a circumference of said second support part, each of said second supports having a second retaining device, wherein each second retaining device is structured to receive one single folding box at the receiving station for conveying the folding box to the transfer station and for transferring the folding box to a downstream conveyor device, said second retaining devices thereby constituting a second group of retaining devices which are all mounted to and rotate as a unit along with said second support part, wherein said second group of retaining devices comprises at least two second retaining devices; and a second drive mechanism connected to said second support part, said second drive mechanism thereby constituting one single common drive for all of said second retaining devices in said second group, said first support part with said first group of retaining devices and said second support part with said second group of retaining thereby being structured to rotate with respect to another with a mutual relative rotation whose magnitude and direction vary throughout the rotation cycle, wherein said first and said second retaining devices are arranged alternately and consecutively in a circumferential direction.

2. The transfer device of claim 1, wherein two support parts are provided, each of which supports three to five retaining devices.

3. The transfer device of claim 1, wherein three support parts are provided, each of which supports two to four retaining devices.

4. The transfer device of claim 1, wherein each of said first and said second support parts is formed from a disc-shaped wheel.

5. The transfer device of claim 4, wherein said wheels are aligned parallel with each other.

6. The transfer device of claim 1, wherein said first and said second retaining devices are uniformly distributed about the circumference of said first and said second support parts.

7. The transfer device of claim 1, wherein said first and second retaining devices are moved along a circular track.

8. The transfer device of claim 1, wherein the folding boxes are separately fed to the transfer station.

9. The transfer device of claim 1, wherein each of said first and second retaining devices has an erecting finger, which can be moved by means of an erecting gear.

10. The transfer device of claim 1, wherein an erecting station is disposed between the receiving station and the transfer station, the erecting station having a counter suction device which follows rotary movement of the folding box in sections.

* * * * *